US008800292B2

(12) United States Patent
Böttcher et al.

(10) Patent No.: US 8,800,292 B2
(45) Date of Patent: Aug. 12, 2014

(54) HEAT SHIELD ELEMENT ARRANGEMENT AND METHOD FOR INSTALLING A HEAT SHIELD ELEMENT

(75) Inventors: Andreas Böttcher, Ratingen (DE); Andre Kluge, Dülmen (DE); Marco Link, Duisburg (DE); Wilhelm Scheidtmann, Iserlohn (DE); Gerhard Simon, Essen (DE); Thomas-Dieter Tenrahm, Dinslaken (DE); Marc Tertilt, Hattingen (DE); Sabine Tüschen, Oberhausen (DE)

(73) Assignee: Siemens Aktiengesellschaft, Munich (DE)

( * ) Notice: Subject to any disclaimer, the term of this patent is extended or adjusted under 35 U.S.C. 154(b) by 538 days.

(21) Appl. No.: 12/795,888

(22) Filed: Jun. 8, 2010

(65) Prior Publication Data

US 2010/0307162 A1 Dec. 9, 2010

(30) Foreign Application Priority Data

Jun. 9, 2009 (EP) ..... 09162239

(51) Int. Cl.
*F02C 1/00* (2006.01)
*F02G 3/00* (2006.01)

(52) U.S. Cl.
USPC ..... 60/752; 60/753; 60/796; 60/798; 60/799

(58) Field of Classification Search
USPC ..... 60/752–760, 796, 798, 799
See application file for complete search history.

(56) References Cited

U.S. PATENT DOCUMENTS

| | | | | |
|---|---|---|---|---|
| 4,749,029 | A * | 6/1988 | Becker et al. | 165/47 |
| 5,083,424 | A * | 1/1992 | Becker | 60/796 |
| 5,431,020 | A * | 7/1995 | Maghon | 60/753 |
| 5,592,814 | A * | 1/1997 | Palusis et al. | 60/770 |
| 5,624,256 | A * | 4/1997 | Pfeiffer et al. | 432/252 |
| 6,341,485 | B1 * | 1/2002 | Liebe | 60/772 |
| 6,360,700 | B1 | 3/2002 | Kern | |
| 6,397,765 | B1 * | 6/2002 | Becker | 110/336 |
| 6,718,774 | B2 * | 4/2004 | Razzell | 60/798 |
| 2006/0176671 | A1 | 8/2006 | Heilos | |
| 2008/0127652 | A1 * | 6/2008 | Putz | 60/752 |

FOREIGN PATENT DOCUMENTS

| | | | |
|---|---|---|---|
| CN | 1427141 | A | 7/2003 |
| CN | 1598463 | A | 3/2005 |
| CN | 101210687 | A | 7/2008 |
| EP | 0558540 | B1 | 9/1993 |
| EP | 1701095 | A1 | 9/2006 |

(Continued)

*Primary Examiner* — Craig Kim

(57) ABSTRACT

A heat shield element arrangement including a heat shield element for a heat shield arranged on a supporting structure is provided. On each of the two opposing sides running parallel to the installation grooves the heat shield element includes a continuous screw head opening which penetrates the cold side and the hot side of the heat shield element substantially vertically and through which the screw head of the respective screw is arranged to be accessible to the supporting structure, and a spring element may be arranged under the respective screw, which spring element may be extended along the hot side of the heat shield element and the parallel installation groove of the supporting structure. An outer end of the spring element is embodied as a clamping retaining hook which is provided for the purpose of engaging in the laterally recessed retaining groove of the heat shield element.

18 Claims, 4 Drawing Sheets

(56) References Cited

FOREIGN PATENT DOCUMENTS

| | | | |
|---|---|---|---|
| EP | 1741981 | A1 | 1/2007 |
| EP | 1884713 | A1 | 2/2008 |
| WO | WO 0146621 | A1 | 6/2001 |
| WO | WO 0163177 | A1 | 8/2001 |
| WO | WO 2006111508 | | 10/2006 |

* cited by examiner

HEAT SHIELD ELEMENT ARRANGEMENT AND METHOD FOR INSTALLING A HEAT SHIELD ELEMENT

CROSS REFERENCE TO RELATED APPLICATIONS

This application claims priority of European Patent Office application No. 09162239.9 EP filed Jun. 9, 2009, which is incorporated by reference herein in its entirety.

FIELD OF INVENTION

The invention relates to a heat shield element arrangement comprising a heat shield element, to a method for installing a heat shield element in a heat shield element arrangement, to a further method for installing a heat shield element in a heat shield element arrangement, and to a use of the heat shield element arrangement having the features cited in the preambles of respective independent claims.

BACKGROUND OF INVENTION

High-performance ceramic heat shields are used in many technical applications in order to withstand temperatures between 1000 and 1600 degrees Celsius. In particular the heat shields of turbine machines such as gas turbines and turbine power plants, as used in electricity-generating power stations and in larger aircraft, have correspondingly large surfaces requiring to be shielded off by means of heat shields in the interior of the combustion chambers. Due to the thermal expansion and to large dimensions the shield has to be composed of a plurality of individual heat shield elements manufactured from ceramic material, which elements are spaced apart from one another by a sufficient gap. Said gap provides the heat shield elements with sufficient space to allow for the thermal expansion. However, since the gap also allows direct contact between the hot combustion gases and the supporting structure carrying the heat shield, a cooling fluid in the form of cooling air is injected through the gaps via cooling ducts in the direction of the combustion chamber as an effective countermeasure. Said cooling air is also used in a targeted manner for blasting and hence cooling the metal retaining fixtures by means of which the ceramic heat shield elements (CHS: Ceramic Heat Shields) are clamped to the supporting structure.

In order to implement the retaining fixtures as simply as possible and ideally as a single piece, a method of construction is known in which said retaining fixtures on the one hand can be inserted in an interlocking manner into the installation grooves embodied circumferentially and in parallel in the supporting structure, and on the other hand are clamped by means of embodied gripper sections into the retaining grooves embodied in lateral edges of the ceramic heat shield element. The heat shield elements are inserted one by one by means of the retainers into the grooves of the supporting structure, with the following elements locking the previously positioned elements in their positions. In this way a circumferential row of heat shield elements can be formed for example in a combustion chamber of a gas turbine.

However, the final remaining heat shield element cannot be installed in this way, because the adjacent heat shield elements present on either side prevent a tangentially directed installation movement. A final heat shield element of said type is often referred to as a dummy panel or blank. Consequently, in order to install the final heat shield element use is made of solutions comprising screw connections which enable the heat shield element to be installed in the direction of the surface normals of the supporting structure.

Toward that end a known screw connection uses screws which engage in the recesses embodied for this purpose in lateral edges of the heat shield element. A disadvantage of this solution is that the installation entails a handling problem. For example, the handling of the four screws necessitates the use of fixing means such as bonding or adhesive tape which are not reliable, as a result of which the screws can get lost and absolutely must be found again prior to startup due to the high risk of a turbine being damaged. Furthermore the overhead installation is difficult because the screws can tilt due to the fixing by means of adhesive tape and consequently cannot be introduced into the drilled holes provided. Since the heat shield is the last one to be installed, the screws cannot be positioned by hand, but must be threaded into the holes—without benefit of sight—by means of a hexagon socket screw key.

EP 1 701 095 A1 and EP 0 558 540 B1 describe by way of example a heat shield embodied as cited hereintofore and having the advantages and problems described. The heat shield elements are also referred to among the technical community as bricks and the retaining elements holding them as brick retainers, and the grooves cut out in the lateral edges of the heat shield elements are referred to as pockets.

SUMMARY OF INVENTION

The object of the present invention is to organize the installation, disassembly and permanent fixing of a heat shield element, in particular a key brick or dummy, in the direction of the surface normals of the supporting structure of a heat shield constructed from a plurality of heat shield elements in a reliable and uncomplicated manner, wherein the fixing elements are to be adequately cooled and not exposed to overheating due to hot gases.

In order to achieve this object the invention proceeds according to a first aspect on the basis of a heat shield element arrangement having a heat shield element, in particular a dummy panel, for a heat shield having a plurality of heat shield elements arranged adjacent to one another on a supporting structure. The heat shield element has a hot side and a cold side, and is securely fixed to the supporting structure, the supporting structure having at least one installation groove per heat shield element row. The heat shield element has recessed cutouts in the form of retaining grooves on two oppositely disposed edge sides in each case running transversely to the parallel installation grooves.

In order to achieve the objects of the invention a heat shield element according to the invention has at least one continuous screw head opening which penetrates the cold side and the hot side of the heat shield element substantially vertically and through which the head of the respective screw is accessible and/or can be freely countersunk as far as the supporting structure. In this case, in particular a hexagon socket screw recess of hexagonal or other shape can be embodied in the head of the screw so that the screw can be turned from the hot side of the heat shield element with the aid of a corresponding hexagon socket tool.

The continuous screw head opening is configured above the installation groove. In addition a drilled screw hole for receiving the threaded shank of the screw is present in the installation groove of the supporting structure, flush with the screw head opening. A spring element serving as a brick retainer can be arranged and/or is arranged under the head of the screw and extends along the cold side of the heat shield element and the installation groove of the supporting structure. In this case at least one outer end of the spring element serving as a brick retainer is embodied as a clamping retaining hook which is equipped for engaging in the laterally recessed retaining groove of the heat shield element.

As a result the heads of the screws and their shanks are brought deeper up to the supporting structure by comparison with the prior art and removed from the gap areas between the heat elements. They are therefore not impinged on directly by the hot gases. Consequently it is possible to dispense entirely with cooling air flow impingement and the overhead and expenditure associated therewith or to simplify and reduce this substantially.

According to a preferred embodiment of the present invention the spring element extends only on one of the two sides having the retaining grooves, wherein two spring elements arranged facing away from each other form a spring element pair in each case.

In a further preferred embodiment of the present invention the spring element extends on both sides of the heat shield element that have the retaining grooves and thus forms a one-piece spring element pair. In this case the spring element is secured to the supporting structure by preferably at least one common screw. Embodied in addition at each of the two outer ends of the spring element is a clamping retaining hook which is provided for engaging in the respective lateral recessed retaining groove of the heat shield element. By means of this arrangement the number of spring elements and screws is reduced, thereby making the installation and disassembly substantially easier to handle.

The one-piece spring element pair can be improved still further if the long side of the spring element extended along the installation groove of the supporting structure has a predefined curvature which is convexly bowed out from the supporting structure such that when the spring element is in the relaxed state the clamping retaining hooks at the ends of the spring element are inclined away from each other by a predefined angle in each case. As a result a clearance is formed between the retaining hooks which allows the heat shield element to be threaded in between the retaining hooks.

A recess is preferably provided on the hot side of the heat shield element in order to accommodate the convex curve of the spring element.

According to another preferred embodiment of the invention a holding-down device is arranged between the hot side of the heat shield element and the spring element, which holding-down device serves to straighten the curve of the spring element by contact pressure and thereby allow the retaining hooks to engage in the retaining grooves at the mutually opposing ends of the spring element.

The drilled screw hole provided in the respective installation groove of the supporting structure can be embodied to receive the threaded shank of the screw continuously through the supporting structure and be implemented in such a way that it can be joined by means of a screw connection to a thread device which can be installed from the rear side of the supporting structure.

Alternatively the drilled screw hole provided in the installation groove of the supporting structure for receiving the threaded shank of the screw can be implemented preferably as a blind hole of defined adequate depth, a threaded insert preferably being installable in addition in the blind hole. The threaded insert can be embodied in particular as a spiral insert or a helicoil. As a result of these measures there is no need to provide a thread device such as a screw nut that requires to be installed from the rear side of the supporting structure. Consequently the installation and disassembly of the heat shield element can be carried out completely from the front side of the supporting structure.

According to a further aspect the objects of the present invention are achieved by means of a method for installing a heat shield element arrangement having a heat shield element and at least one spring element on a supporting structure according to a previously described embodiment.

The inventive installation of the heat shield element is carried out in such a way that the spring element is installed for the purpose of engaging in the retaining groove on the heat shield element, the screw is introduced into the associated continuous screw head opening and inserted through a screw opening provided in the spring element, the heat shield element with installed spring element and screw is mounted on the supporting structure in a movement normal to the surface of the supporting structure such that the threaded shank of the screw engages in the associated drilled screw hole of the supporting structure, and the screw is tightened.

The spring elements are preferably fixed by means of an adhesive bond so that they remain attached to the heat shield element during the installation. In an alternative embodiment of the installation method the screw can also be threaded into the drilled screw hole of the supporting structure subsequently via the screw head opening and the drilled hole in the spring element and screwed home.

In this arrangement either a threaded insert previously introduced into the blind hole of the supporting structure or a threaded nut that is accessible through the continuous drilled screw hole of the supporting structure is used as the thread device. Thus, both types of screwed connection can optionally be used in terms of the construction.

Finally the objects of the present invention are achieved according to a further aspect by means of a use of the heat shield element arrangement according to a previously described preferred embodiment for embodying a heat shield, in particular a key brick or dummy brick of the heat shield, of an internal combustion engine, in particular a turbine. For this purpose the turbine can preferably be a gas turbine.

BRIEF DESCRIPTION OF THE DRAWINGS

The invention is explained below in exemplary embodiments with reference to the associated drawings, in which.

DETAILED DESCRIPTION OF INVENTION

Figure 1:
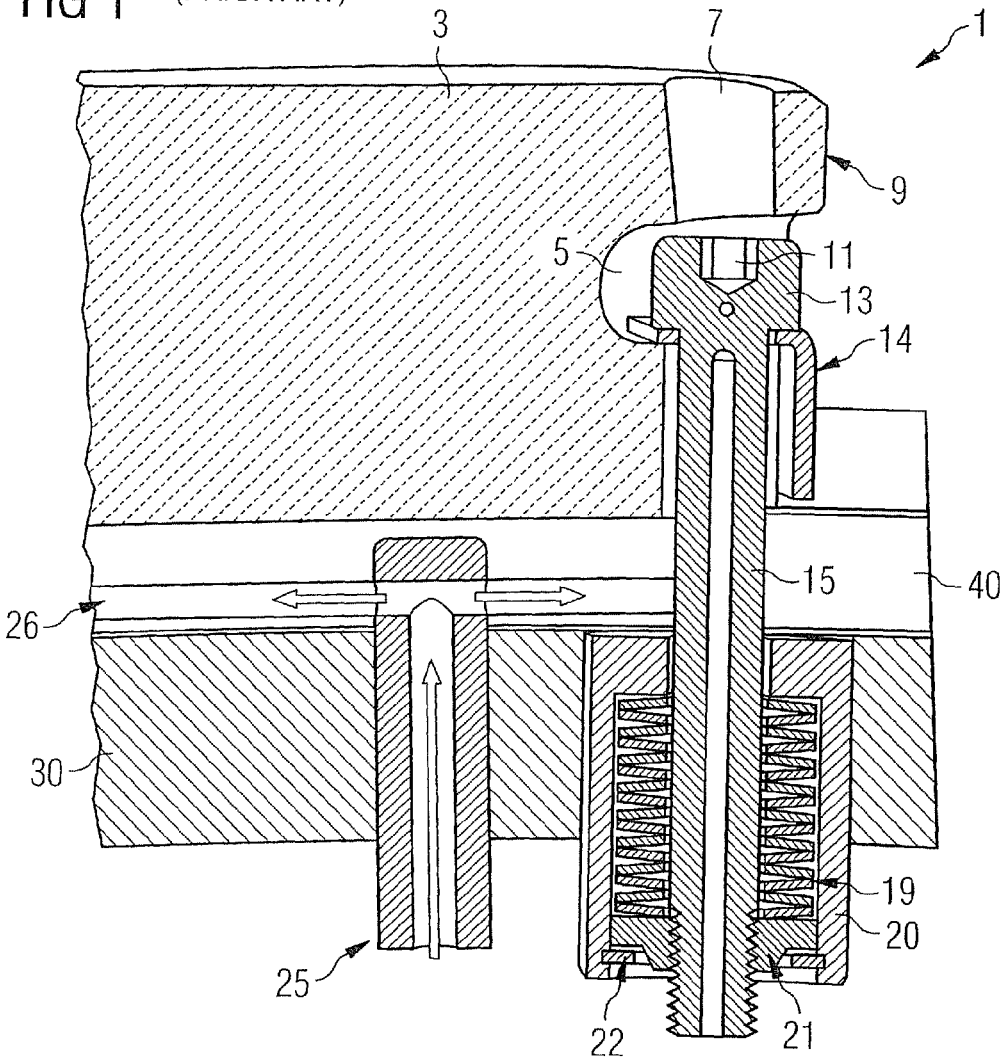
FIG 1 (PRIOR ART)
FIG. 1 shows a partial cross-sectional view through a known heat shield element arrangement.
Figure 2:
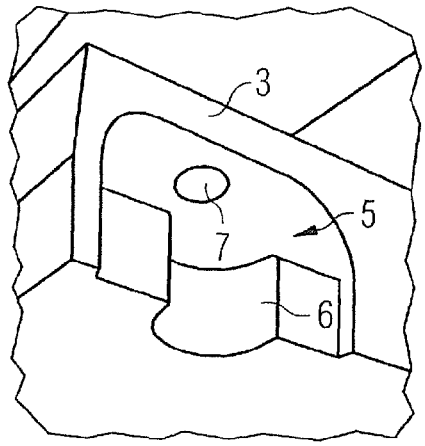
(PRIOR ART) FIG 2
FIG. 2 shows a perspective partial view onto the known heat shield element from FIG. 1.

FIGS. 1 and 2 show a partial cross-sectional view through a known heat shield element arrangement 1.

In the case of the known heat shield element arrangement 1 the heat shield elements 3 or bricks are secured to the supporting structure 30 with the aid of a total of four screw connections.

Recesses or pockets 5 with lateral cutouts 6 are formed in the lateral edges of the heat shield element 3, in which cutouts the screw shank 15 and screw head 13 can be inserted laterally. Arranged under the screw head 13 is a pressure distributor or washer 14 which distributes the pressure over a larger area and thereby avoids the risk of damaging the ceramic body of the heat shield element 3.

According to the prior art a heat shield element 3 having just four installed screws 13/15 and pressure distributors 14 must now be mounted vertically onto the supporting structure 30, and the four screw shanks 15 must be threaded into the four drilled screw holes correspondingly arranged in the supporting structure 30. Because the screws freely inserted laterally into the pockets 5 can easily fall out, they are first fixed in their positions by means of an adhesive or adhesive tape. Said adhesive bond easily gets lost during the threading-in operation, however, and the screws can either fall out or be twisted and consequently no longer slot accurately into the drilled screw holes of the supporting structure 30.

Because the screws jut out relatively high, they are impinged on by the hot gases flowing through the gaps between the adjacent heat shield elements 3 and reach high temperatures, as a result of which cooling is necessary. The cooling is implemented for example as ventilation via channels and ventilation lines 25. The installation groove 40 of the supporting structure 30 or channels specially formed in the supporting structure can serve as a cooling duct.

Because the thermal expansion of the ceramic heat shield element 3 and the metal screw 15 is considerable and different in this type of installation, the screw 15 must also be screwed in a spring retainer package 19. The spring retainer package 19 is an additional expensive and complicated component and is installed in a package sleeve 20 which is sealed off by a retention washer 22. Said retention washer 22 prevents the plate spring and the threaded nut 21 from falling out when the screw 15 has not yet been inserted.

Said known arrangement is thus complex in terms of its construction and difficult to handle during installation/disassembly, so that sometimes two pairs of hands are required.

Figure 3:
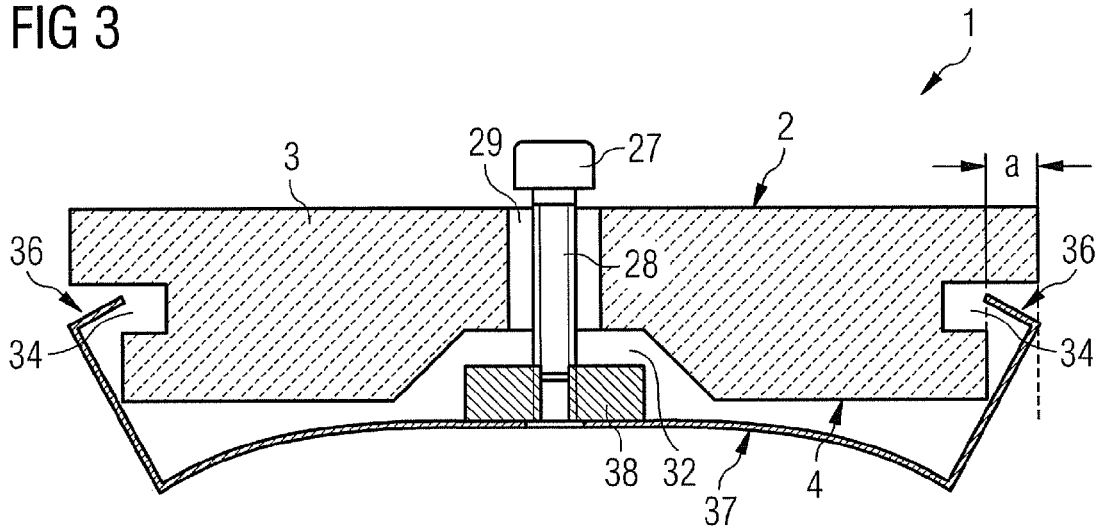
FIG. 3 shows a cross-sectional view of a first inventive heat shield element arrangement prior to installation.

FIG. 3 shows a cross-sectional view of a first inventive heat shield element arrangement 1 prior to installation.

In the relaxed state the one-piece spring element 37 is provided with a curve 37 which bulges out convexly from the surface of the supporting structure 30. As a result of said predefined curve the two retaining hooks 36 provided at the outer ends of the spring element 37 are splayed out from each other at a predefined angle. Said predefined spread is possibly widened out further manually in order to thread in the heat shield element 3 between the retaining hooks 36 and secure it in position. As a result of its being secured in position the heat shield element 3 can be conveniently handled by the two spring elements 37 mounted on it. Thus, for example, as the next step the screw 28 can be inserted into the screw head opening.

A holding-down device 38 is installed on the side of the curve 37 of the spring element facing toward the cold side 4 of the heat shield element 3. Said holding-down device 38 can be inset at least partially in a recess 32 embodied in the heat shield element on the cold side 4, with the result that the retaining hooks 36 can remain splayed during the above-described threading-in operation.

Figure 4:
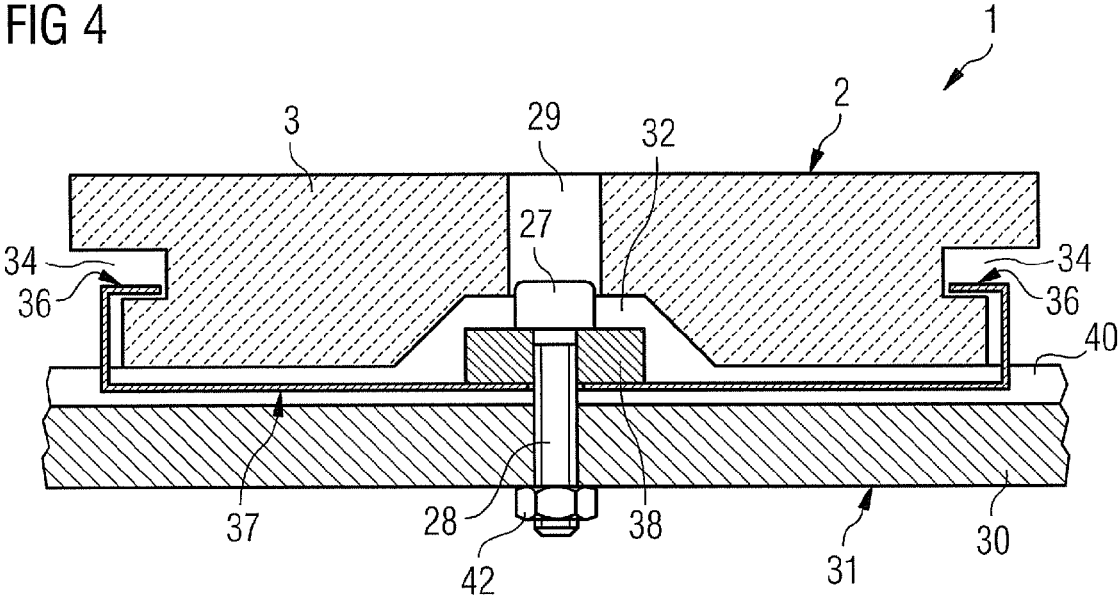
FIG. 4 shows a cross-sectional view of the first inventive heat shield element arrangement after installation.

FIG. 4 shows a cross-sectional view of the first inventive heat shield element arrangement 1 from FIG. 3 following its installation on the supporting structure 30.

Toward that end the supporting structure 30 has a drilled screw hole which in the present example is implemented as a continuous drilled hole. The one-piece spring element pair 37 is inserted into an installation groove 40 embodied in the supporting structure 30, as a result of which the heat shield element 3 bears directly on the supporting structure 30. Tightening the screw 28 causes the holding-down device 38 to be pressed down to the floor of the groove, thereby straightening the curve of the spring element 37, with the result that the retaining hooks 36 engage on both sides in the respective lateral retaining groove 34 of the heat shield element 3 and thus securely retain the latter. Owing to the predefined spring force of the spring elements 37 the heat shield element is pressed against the supporting structure 30 and the thermal expansion of the heat shield element 3 is thus also compensated by the resiliently yielding spring elements 37.

As a result it is no longer necessary to intercept the screws 28 in a spring retainer package as described with reference to FIG. 1. A simple threaded nut 42 can be used which is to be installed from the rear side of the supporting structure 30.

The screw head opening 29 is preferably embodied with the same diameter throughout and ensures the accessibility of the screw head 27 of the screw 28 from the hot side 2 of the heat shield element 3. The installation or disassembly can thus be carried out with the aid of a turning tool, a hexagon socket wrench, for example, which can be inserted through the screw head opening 29 into the hexagon socket recess 11 of the screw head 27.

In an advantageous embodiment the diameter of the screw head opening 29 in the heat shield element is furthermore somewhat greater than the diameter of the screw head 27 of the screw 28, such that the screw head 27 can be inserted through the screw head opening 29.

This enables the installation and disassembly of the heat shield element to be easily handled.

It is of advantage, though not mandatory, for the position of the screw 28 to be arranged symmetrically in the center, because in that way the one-piece spring element 37 will have spring shoulders of the same length toward both sides and consequently identical spring forces will act at each of the four fixing points of the heat shield element 3.

The predefined offset a between the top edge and the bottom edge of the lateral retaining groove 34 of the heat shield element 3 ensures that even in the splayed state the retaining hooks 36 still have sufficient space to allow the preinstalled heat shield element arrangement to be introduced between the already preinstalled adjacent heat shield elements.

Figure 5:
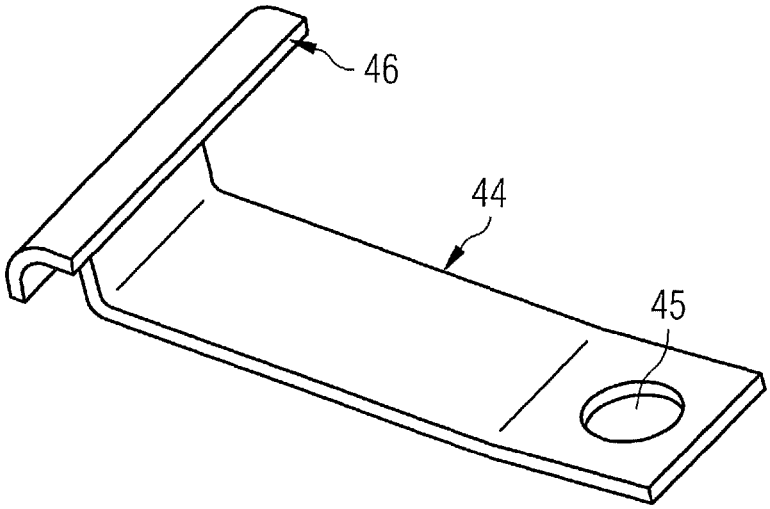
FIG. 5 shows a perspective view of an inventive spring element.

FIG. 5 shows a perspective view of an inventive spring element 44 which, in a second preferred embodiment of the invention, is divided into two parts.

Said spring element 44 bears a great similarity to the conventional brick retainers. It has a drilled hole 45, which is provided for fixing purposes by means of a screwed connection, and a retaining hook 46, which is provided for engaging in the lateral retaining groove 34 of the heat shield element 3.

Figure 6:
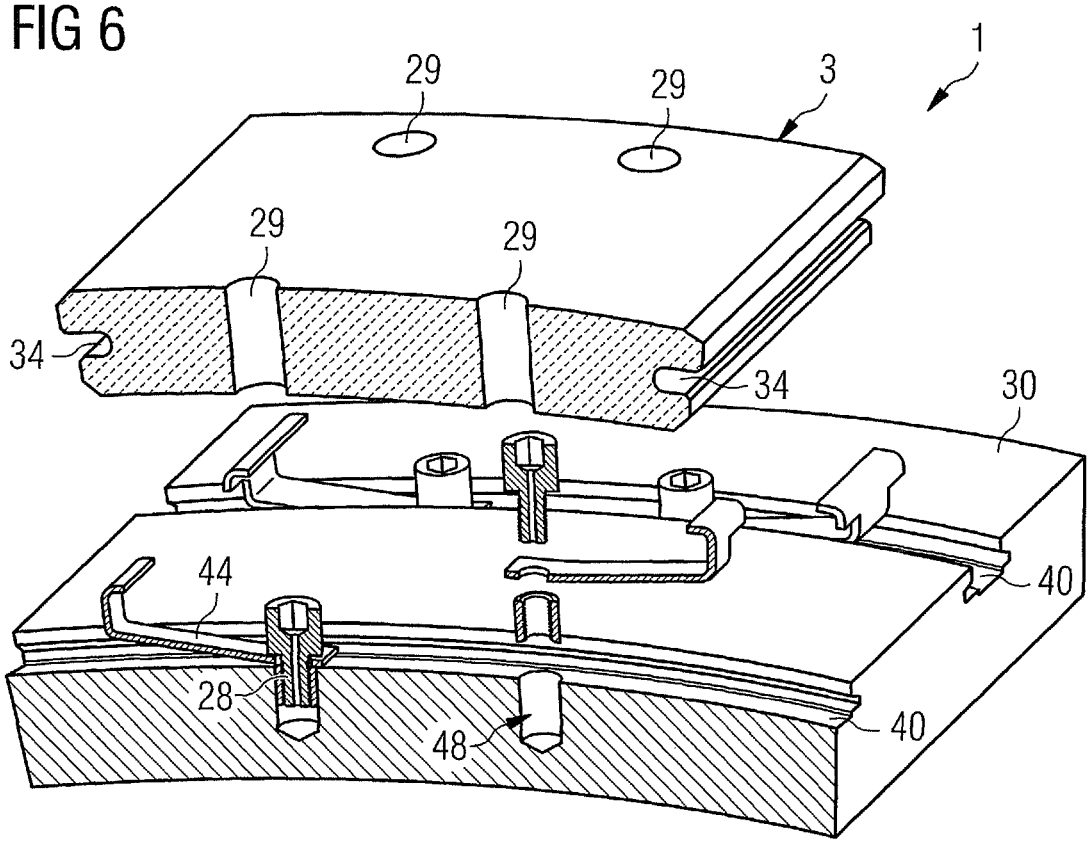
FIG. 6 shows a perspective exploded view of a second inventive heat shield element arrangement.

FIG. 6 shows a perspective exploded cross-sectional view of a second inventive heat shield element arrangement 1.

The supporting structure 30 has a parallel arrangement of two circumferential installation grooves 40 per heat shield element row. A total of four screw connection drilled holes, in this case implemented by way of example as blind holes 48, are provided in the floor of said installation grooves 40.

In the lateral edges arranged transversely to the installation grooves 40 the heat shield element 3 has on each side a recess in each case in the form of a retaining groove 34 into which the retaining hooks of the spring elements 44 engage.

According to the invention four screw head drilled holes 29 are provided which penetrate through the heat shield element 3, preferably with the same diameter throughout.

Figure 7:
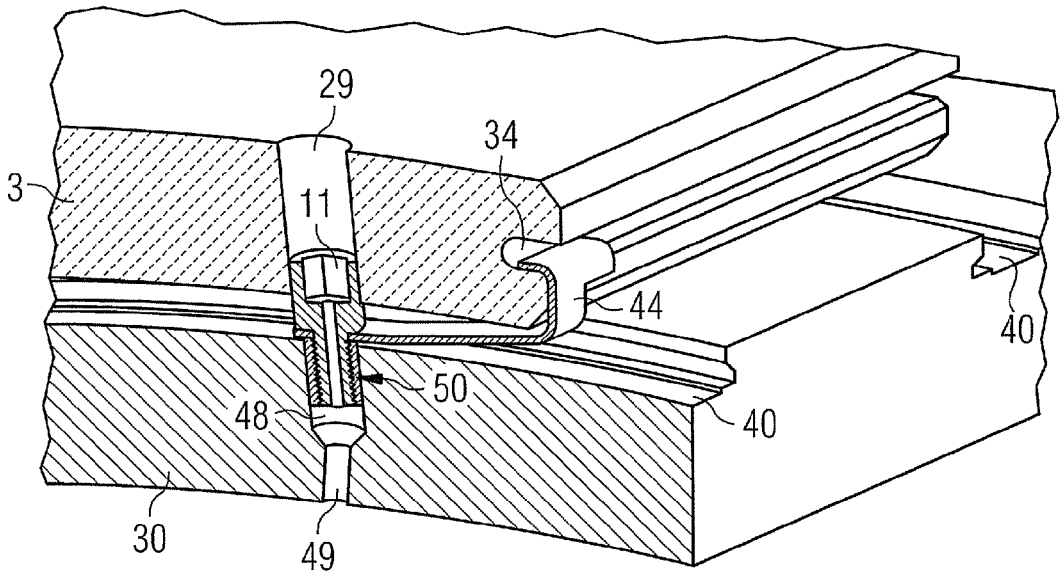
FIG. 7 shows a perspective cross-sectional view of the second inventive heat shield element arrangement during installation.
Figure 8:
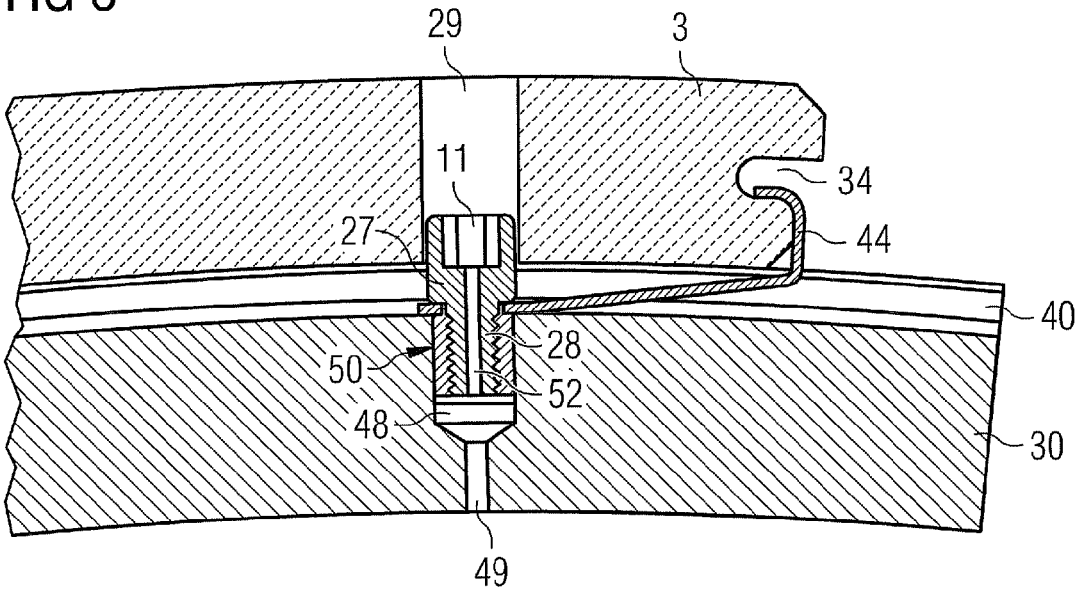
FIG. 8 shows a lateral cross-sectional view of the second inventive heat shield element arrangement.

FIG. 7 and FIG. 8 show the same embodiment from FIG. 6 in a perspective cross-sectional view following installation of a spring element 44.

In this case the heat shield element 3 bears against the supporting structure 30 and, as in the case of the embodiments described with reference to FIGS. 3 and 4, the spring element 44 is recessed in the installation groove 40 of the supporting structure 30.

The spring element 44 is in this case screwed in position by means of a screw 28, which is inserted through the drilled hole 45 of the spring element, in a blind hole 48 embodied in the floor of the installation groove 40 by means of a threaded insert 50. For that purpose the screw head 27 of the screw 28 can be inserted through the screw head opening 29 of the heat shield element 3.

The spring element 44 is under tension in the installed state such that it exerts a compressive force which presses the heat shield element 3 against the supporting structure 30 at a total of four corner region points. This compensates in this embodiment also for the thermal expansion of the heat shield element 3, thereby removing the need for a spring retainer package.

The blind hole 48 enables the heat shield element 3 to be installed and disassembled exclusively from the hot side.

Furthermore it is of advantage in a preferred embodiment to equip the blind hole 48 with a channel 49 from the rear side of the supporting structure 3 and to embody an air duct 52 through the screw 28. By means of these easy-to-implement ventilation ducts cooling air can be introduced for the purpose of cooling the screw head 27 of the screw 28 as necessary.

In the installation of the heat shield element 3 according to this embodiment the four spring elements 44 are inserted into the lateral retaining groove 34 at the four points and secured therein by means of adhesive tape. The preliminary assembly is then inserted vertically onto its position between the adjacent heat shield elements. The four screws 28 are then inserted through the respective associated screw head openings 29 and threaded through the drilled holes 45 of the spring elements 44 into the threaded inserts inserted in the blind holes 48 and screwed home by means of a hexagon socket tool.

The invention claimed is:

1. A heat shield element arrangement, comprising:

a heat shield element for a heat shield, comprising:

a hot side;

a cold side;

a plurality of recessed cutouts in a form of retaining grooves on two oppositely disposed edge sides in each case running transversely to a plurality of parallel installation grooves; and two continuous screw head openings, wherein the two oppositely disposed edge sides span two parallel installation grooves;

wherein the heat shield includes a plurality of heat shield elements arranged adjacent to one another on a supporting structure, wherein the heat shield element is securely fixed to the supporting structure, wherein the supporting structure includes two installation grooves per heat shield element row, each installation groove elongated in a direction parallel to the heat shield element row, and wherein the continuous screw head openings, which penetrate the cold side and the hot side of the heat shield element substantially vertically and through which a screw head of a respective screw is arranged so as to be accessible, may be freely countersunk as far as the supporting structure, wherein each continuous screw head opening is configured over a respective installation groove, and wherein a respective drilled screw hole for accommodating a threaded shank of the respective screw is provided in the respective installation groove of the supporting structure, wherein a respective spring element is arranged under the respective screw head of the respective screw and extend along the cold side of the heat shield element in the respective installation groove of the supporting structure, and wherein an outer end of the spring element is embodied as a clamping retaining hook which is embodied for engaging in one of the lateral recessed retaining grooves of the heat shield element.

2. The heat shield element arrangement as claimed in claim 1, wherein each of the spring elements extends only to one of the two edge sides of the heat shield element that includes the plurality of retaining grooves, and wherein two spring elements facing away from each other and form a two-piece spring element pair for each installation groove.

3. The heat shield element arrangement as claimed in claim 1, wherein each spring element extends to both edge sides of the heat shield element that includes the plurality of retaining grooves and thus forms a one-piece spring element pair, wherein each spring element pair is securely fixed to the supporting structure using the respective screw, wherein a clamping retaining hook is embodied at each of the two outer ends of the spring element pair, and wherein each clamping retaining hook is provided for engaging in the respective lateral recessed retaining groove of the heat shield element.

4. The heat shield element arrangement as claimed in claim 3, wherein a long side of each spring element pair extending within the respective installation groove of the supporting structure includes a curve which is convexly bowed out from the supporting structure such that when the spring element pair is in a relaxed state the respective clamping retaining hooks at the ends of the spring element are splayed apart from each other by a predefined angle in each case, thereby forming a clearance between the respective retaining hooks which allows the heat shield element to be threaded in between the respective retaining hooks.

5. The heat shield element arrangement as claimed in claim 4, wherein a recess is provided in the cold side of the heat shield element and is embodied for receiving a convex curve of each spring element pair.

6. The heat shield element arrangement as claimed in claim 4, wherein a respective holding down device is arranged between the cold side of the heat shield element and the respective spring element, and wherein each holding-down device serves to straighten the curve of the respective spring element by contact pressure thereby causing the respective retaining hooks at the opposite ends of the respective spring element to engage in the plurality of retaining grooves.

7. The heat shield element arrangement as claimed in claim 1, wherein the drilled screw holes provided in the installation grooves of the supporting structure for the purpose of receiving a threaded shank of the screw are each embodied continuously through the supporting structure.

8. The heat shield element arrangement as claimed in claim 1, wherein the drilled screw holes provided in the installation grooves of the supporting structure for the purpose of receiving the threaded shank of the screw are each implemented as a blind hole.

9. The heat shield element arrangement as claimed in claim 8, wherein a respective threaded insert may be installed in each blind hole.

10. The heat shield element arrangement as claimed in claim 9, wherein the respective threaded inserts are embodied as a spiral insert or a helicoil.

11. The heat shield element arrangement as claimed in claim 1, wherein each of the continuous screw head openings has a same first diameter throughout and first diameter is greater than a second diameter of the screw head of the screw.

12. A method for installing a heat shield element arrangement including a heat shield element and a spring element on a supporting structure, comprising:

providing a heat shield element comprising:

a hot side;

a cold side;

a retaining groove on each of two oppositely disposed side edges running transversely to an installation groove;

installing the heat shield element into the installation groove, the steps of installing the heat shield element comprising:

installing the spring element on the heat shield element in order to engage the retaining grooves with a retaining hook;

introducing a screw into an associated continuous screw head opening;

inserting the screw through a drilled hole provided in the spring element;

installing the heat shield element together with the installed spring element and the screw on the supporting structure in a movement normal to a surface of the supporting structure such that a threaded shank of the screw engages in the associated drilled screw hole of the supporting structure;

tightening the screw which engages the hook into the retaining groove, and installing an additional heat shield element in the installation groove.

13. A heat shield element arrangement, comprising:

a plurality of heat shield elements arranged adjacent to one another to form a row supported by a supporting structure, at least one heat shield element comprising:

a hot side;

a cold side;

a retaining groove on each of two oppositely disposed edge sides; and a continuous screw head opening oriented substantially vertically through the cold side and the hot side of the heat shield element, a support structure comprising an installation groove associated with and elongated parallel to the heat shield element row, and a screw hole disposed in the installation groove, a screw disposed in the screw hole and accessible through the continuous screw head opening, and a spring element at least partly retained by the screw and extending within the installation groove to the retaining groove, the spring element comprising a clamping retaining hook configured to engage a respective retaining groove and secure the heat shield element to the supporting structure.

14. The heat shield element arrangement of claim 13, wherein the row of heat shield elements forms a circumferential row, and wherein the installation groove forms a circumferential groove encircling the circumferential row of heat shield elements, and wherein at least two of the heat shield elements are secured via the installation groove.

15. The heat shield element arrangement of claim 13, wherein the spring element comprises two discrete parts, each extending in a direction opposite the other within the installation groove, at least one of the two discrete parts being retained by the screw, and each discrete part configured to engage a respective retaining groove via a respective retaining hook.

16. The heat shield element arrangement of claim 13, wherein the heat shield element comprises a second continuous screw head opening oriented substantially vertically through the cold side and the hot side of the heat shield element, wherein the support structure comprises: a second installation groove associated with and elongated parallel to the heat shield row; and a second screw hole disposed in the second installation groove, and wherein the heat shield arrangement further comprises a second screw disposed in the second screw hole and accessible through the second continuous screw head opening; and a second spring element retained by the second screw and extending within the second installation groove to the retaining groove, the second spring element comprising a second clamping retaining hook configured to engage a respective retaining groove and secure the second heat shield element to the supporting structure.

17. The method as claimed in claim 12, wherein a threaded insert previously inserted in the drilled screw holes of the supporting structure or a threaded nut that is accessible through the continuous drilled screw holes of the supporting structure is used as a thread device.

18. The heat shield element arrangement as claimed in claim 8, wherein each of the blind holes is equipped with a channel from a rear side of the supporting structure, and wherein an air duct is included through each screw.

* * * * *